US006508045B2

(12) United States Patent
Kim

(10) Patent No.: US 6,508,045 B2
(45) Date of Patent: Jan. 21, 2003

(54) DRUM OF MEDICINE SHARING AND PACKING DEVICE

(75) Inventor: June Ho Kim, Daegu (KR)

(73) Assignee: JV Medi Co., Ltd., Daegu (KR)

( * ) Notice: Subject to any disclaimer, the term of this patent is extended or adjusted under 35 U.S.C. 154(b) by 0 days.

(21) Appl. No.: 09/964,354

(22) Filed: Sep. 28, 2001

(65) Prior Publication Data

US 2002/0100765 A1 Aug. 1, 2002

(30) Foreign Application Priority Data

Jan. 26, 2001 (KR) ..... 2001-0001878

(51) Int. Cl.[7] ..... B65B 35/34

(52) U.S. Cl. ..... 53/154; 221/119; 221/130; 53/237

(58) Field of Search ..... 221/119, 120, 221/123, 124, 129, 130, 131, 133, 281, 93, 94; 53/154, 237

(56) References Cited

U.S. PATENT DOCUMENTS 1,121,804 A * 12/1914 Coulson ..... 222/133
3,871,156 A * 3/1975 Koenig et al. ..... 53/59 R
4,915,259 A * 4/1990 Guigan et al. ..... 221/120
5,413,245 A * 5/1995 Wright ..... 221/24
5,667,096 A * 9/1997 Wu ..... 221/6
5,709,063 A * 1/1998 Yuyama et al. ..... 53/154
5,787,678 A * 8/1998 Koike et al. ..... 53/154
5,852,911 A * 12/1998 Yuyama et al. ..... 53/168
5,964,374 A * 10/1999 Yuyama et al. ..... 221/17
6,012,602 A * 1/2000 Yuyama et al. ..... 221/130
6,050,064 A * 4/2000 Yuyama et al. ..... 53/514
6,145,700 A * 11/2000 Takahashi et al. ..... 221/133
6,202,385 B1 * 3/2001 Kim ..... 53/154
6,263,639 B1 * 7/2001 Kim ..... 53/154
6,308,494 B1 * 10/2001 Yuyama et al. ..... 53/131.3
6,349,848 B1 * 2/2002 Uema et al. ..... 221/6

FOREIGN PATENT DOCUMENTS

JP 9-175510 * 7/1997 ..... B65B/37/02

* cited by examiner

*Primary Examiner*—Donald P. Walsh
*Assistant Examiner*—Daniel K Schlak
(74) *Attorney, Agent, or Firm*—Jacobson Holman PLLC

(57) ABSTRACT

A drum of a medicine sharing and packing device, wherein a drum has a plurality of tablet cassettes 2*a* arranged and passages 2*b* formed to guide tablets down, comprises a barrel-shaped drum body 2*c* formed in two circular arc shapes facing each other and auxiliary drums 2*e* mounted inside of the drum body 2*c* so as for opening portions 2*d* of the drum body 2*c* to be closed. The drum body 2*c* has the opening portions 2*d* on both sides facing each other and a plurality of tablet cassettes 2*a* arranged detachably on the outer circumferential surface. The two circular arc-shaped auxiliary drums have a plurality of tablet cassettes 2*a* arranged detachably on their inner surfaces and mounted inside of the drum body 2*c* so as for the centers of their outer surfaces to come into contact with each other.

4 Claims, 3 Drawing Sheets

DRUM OF MEDICINE SHARING AND PACKING DEVICE

BACKGROUND OF THE INVENTION

The present invention relates to a drum which is used in a medicine sharing and packing device designed to distribute and pack a variety of tablets per dose, and more particularly, a drum for a medicine sharing and packing device which facilitates attachment and detachment of tablet cassettes containing tablets and enables a user to change tablet cassettes easily.

In general, a medicine sharing and packing device denotes a machine designed to automatically distribute a variety of tablets prescribed for a patient's disease and pack them dose by dose.

For the above medicine sharing and packing device, a plurality of tablet cassettes containing a variety of tablets are arranged on a drum, individual tablet cassettes are intermittently controlled to discharge tablets prescribed dose by dose to the downside through passages provided at a drum, and tablets discharged from the drum are gathered into a hopper, discharged down under the hopper, and put into a packing sheet for packing.

A conventional drum, as disclosed in my Utility Model Registration Application No. 14638, 1998, comprises a barrel-shaped drum body with opening portions formed on both sides facing each other, and auxiliary drums which are mounted inside of the drum body which is divided by the opening portions.

In other words, the drum body is in two circular arc shapes facing each other without coming into contact with each other, and the auxiliary drums are mounted inside of the drum body so as to face each other in the state of the opening portions being open to enable a user to change tablet cassettes through them.

Of course, a plurality of tablet cassettes are arranged on the circumferential surface of the drum body and auxiliary drums, and tablets in the tablet cassettes are dropped through passages formed in the drum.

Therefore, the conventional drum is so structured that, as noted above, auxiliary drums are mounted inside of the drum body to accommodate a plurality of additional tablet cassettes, thereby allowing various kinds of tablets to be distributed and packed.

For the conventional drum, it is difficult to change tablet cassettes which are located in the central part of the drum body since the auxiliary drums are mounted on both sides with the opening portions of the drum body being not closed and accordingly the position of the tablet cassettes installed in the auxiliary drums differs.

When changing tablet cassettes in the central part of the drum body, it is possible to change tablet cassettes of an auxiliary drum at one opening portion while changing them at the other opening portion. In this case, a user may not want to rotate the drum body and so continue changing table cassettes at one opening portion. Then, the changing work may not be performed properly.

SUMMARY OF THE INVENTION

The present invention is contrived to overcome the conventional disadvantages described above. Therefore, it is an object of the present invention to provide a drum of a medicine sharing and packing device, wherein tablet cassettes arranged on auxiliary drums mounted inside of a drum body are disposed at the same position centering around a user or worker, thereby facilitating attachment and detachment of table cassettes containing tablets and enabling a user to change tablet cassettes easily.

To achieve the above-described object, a drum of a medicine sharing and packing device designed to pack tablets prescribed dose by dose, wherein a drum is mounted so as to be rotated and has a plurality of tablet cassettes arranged and passages formed to guide tablets down, comprises a barrel-shaped drum body with opening portions formed on both sides facing each other and a plurality of tablet cassettes arranged detachably on the outer circumferential surface, and two circular arc-shaped auxiliary drums having a plurality of tablet cassettes arranged detachably on their inner surfaces and mounted inside of the drum body so as for the centers of their outer surfaces to come into contact with each other.

DETAILED DESCRIPTION OF THE PREFERRED EMBODIMENTS

With reference to the accompanying drawings, the present invention will now be described.

Figure 1:
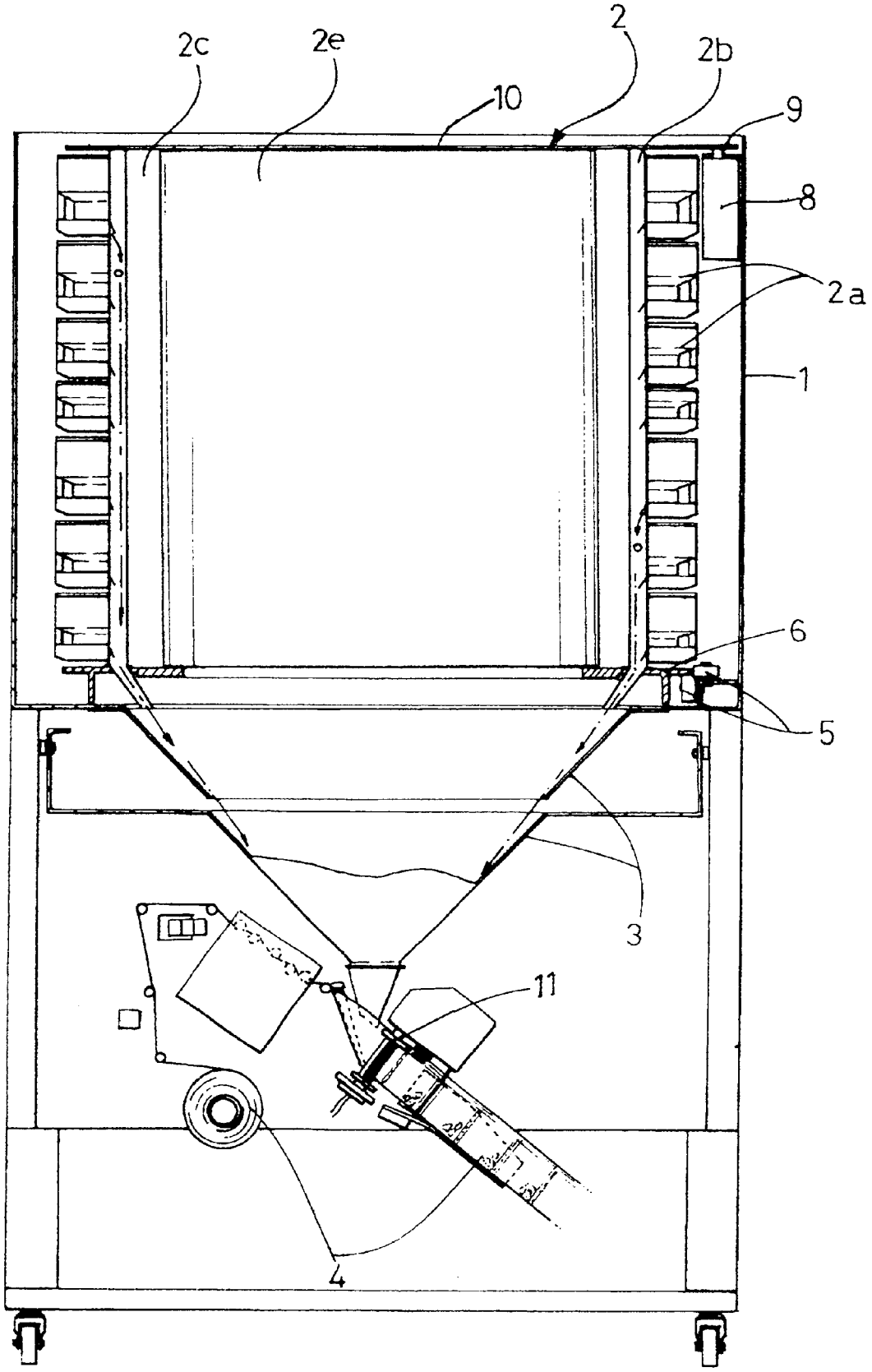
FIG. 1 is a partial cross-sectional view of a medicine sharing and packing device to which a drum according to the present invention applies.

FIG. 1 shows a medicine sharing and packing device to which a drum according to the present invention applies. The medicine sharing and packing device is so structured that a drum 2 is mounted inside of a case 1 so as to be rotated, a double-layer hopper 3 is mounted under the drum 2, and a packing means for packing tablets, dropped from the hopper 3 dose by dose, using a packing sheet 4, is provided.

For the drum 2 a plurality of tablet cassettes 2*a* are arranged and passages 2*b* are formed to guide tablets down.

As illustrated in FIGS, 1 and 2, the drum 2 according to the present invention, comprises a barrel-shaped drum body 2*c* formed in two circular arc shapes facing each other and auxiliary drums 2*e* mounted inside of the drum body 2*c* so as for the inside of the opening portions 2*d* of the drum body 2*c* to be closed.

The drum body 2*c* has the opening portions 2*d* formed on both sides facing each other and a plurality of tablet cassettes 2*a* arranged detachably on the outer circumferential surface, and the two auxiliary drums 2*e* formed in a circular arc shape have a plurality of tablet cassettes 2*a* arranged detachably on their inner surfaces and mounted inside of the drum body 2*c* so as for the centers of their outer surfaces to come into contact with each other.

Figure 2:
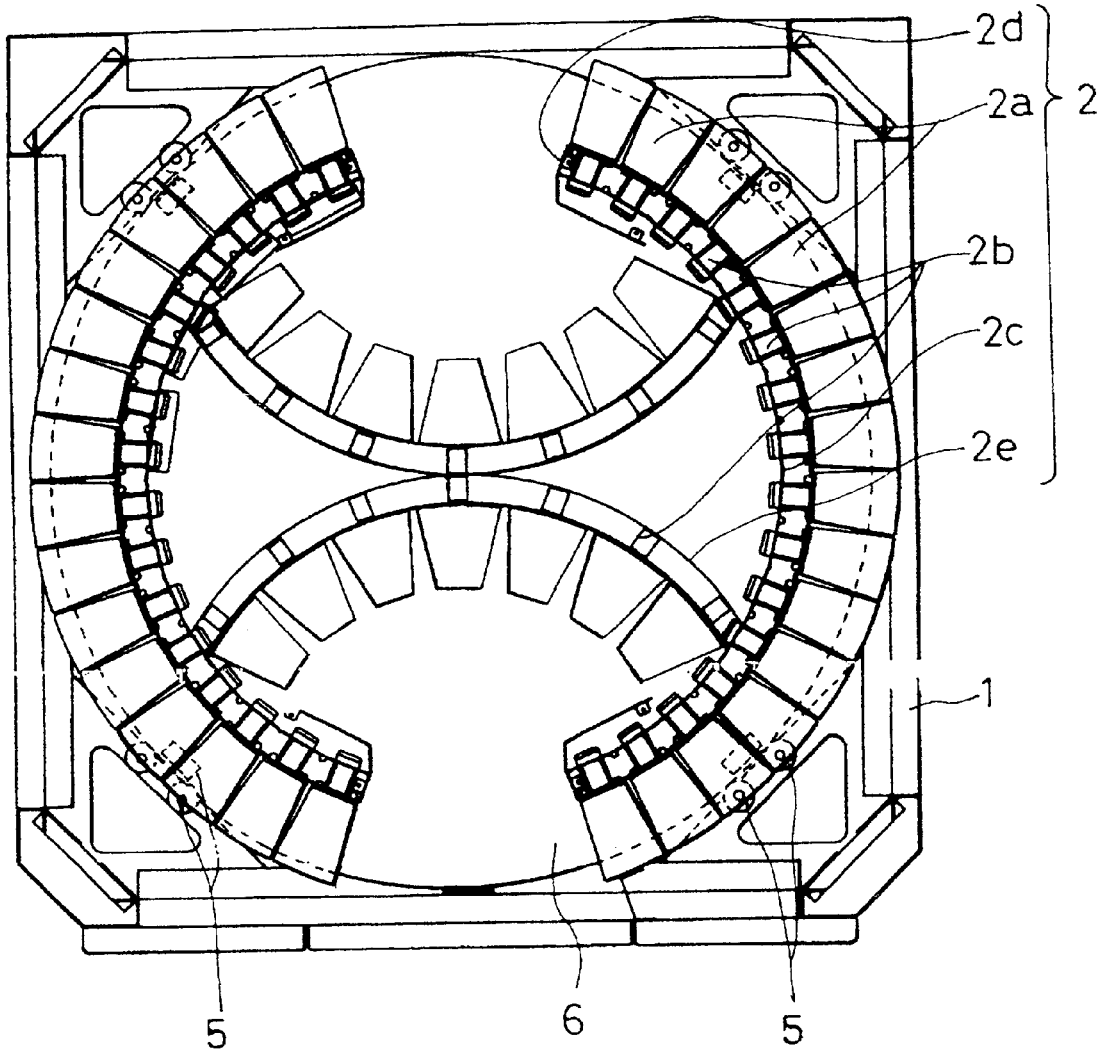
FIG. 2 is a transverse section of a drum of a medicine sharing and packing device according to the present invention.
Figure 3:
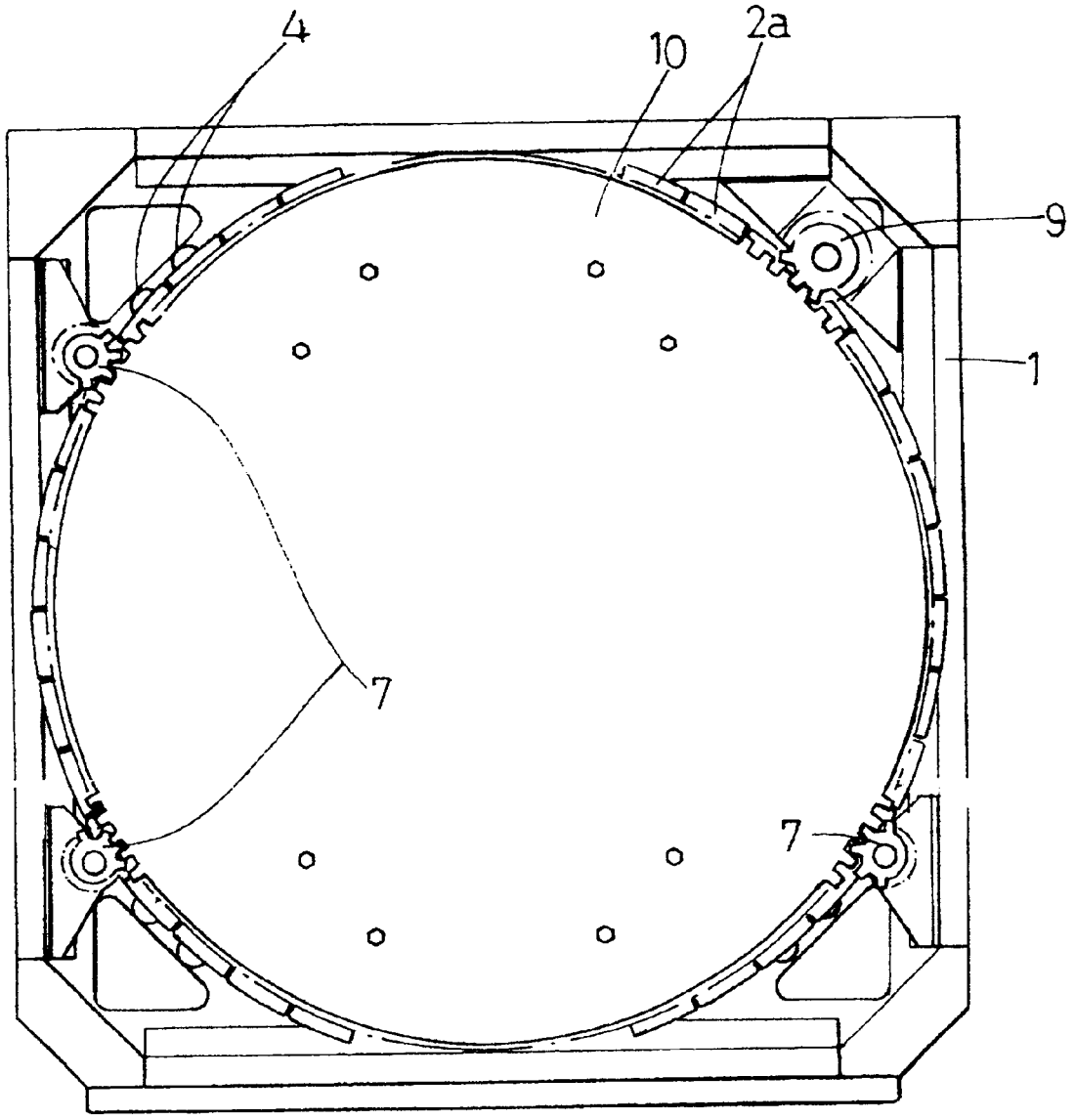
FIG. 3 is a transverse section showing a driving means for a drum of a medicine sharing and packing device according to the present invention.

As illustrated in FIGS. 1 and 2, a rotary plate 6 is mounted under the drum 2. The edge portion and circumferential surface of the rotary plate 6 are supported by a plurality of rollers 5. As illustrated in FIGS. 1 and 3, a gear plate 10 is mounted over the drum 2. The gear plate 10 is supported by a plurality of idle gears 7 and engaged with a driving gear 9 driven by a motor 8.

A packing sheet 4, which is folded in the direction of width, travels at the lower outlet of the hopper 3, a pair of heating rollers 11 are mounted to seal the folded packing sheet in both directions of length and width, and a plurality of tablet cassettes 2*a* mounted in the drum 2 are actuated by an electrical signal to discharge contained tablets one by one.

In the drum constructed as described above, tablets contained in the tablet cassettes 2*a* are dropped down by the operation of the tablet cassettes 2*a* into the hopper 3 through the passages 2*b*, discharged down after being gathered into the hopper 3, and packed and sealed dose by dose by the heating rollers 11.

When the tablet cassettes 2*a* become empty, they should be detached to fill them with tablets. In this case, tablet cassettes 2*a* on the circumferential surface of the drum body 2*c* are changed as conventional, and tablet cassettes 2*a* on the inner circumferential surfaces of the auxiliary drums 2*e* can be changed easily through the opening portions 2*d* of the drum body 2*c*.

Of course, the drum is also easily rotated by the motor 8 and a plurality of rollers 5.

Accordingly, the tablet cassettes 2*a* of the auxiliary drum 2*e* are located at the same radius so that the change of tablet cassettes can be done easily.

As discussed above, the drum of a medicine sharing and packing machine according to the present invention allows tablet cassettes to be attached and detached since tablet cassettes arranged on auxiliary drums mounted inside of a drum body are disposed at the same position centering around a user or worker.

As the opening portions of the drum body remains closed by two auxiliary drums, the other opening portion should be positioned in front of an user by rotating the drum body in order to change tablet cassettes in the auxiliary drums on the opposite side. Therefore, the changing work can be done smoothly and properly by preventing a user from changing tablet cassettes forcedly.

What is claimed is:

1. A drum of a medicine sharing and packing device designed to pack tablets prescribed dose by dose, wherein said drum is mounted so as to be rotated and has first and second pluralities of tablet cassettes arranged and with passages formed to guide tablets down, comprising a barrel-shaped drum body with opening portions formed on opposing sides facing each other on an inner circumferential surface of said drum body, said first plurality of tablet cassettes arranged detachably on an outer circumferential surface, and two circular arc-shaped auxiliary drums having a said second plurality of tablet cassettes arranged detachably on inner surfaces of said auxiliary drums, said auxiliary drums mounted inside of said drum body with centers of said two circular arc-shaped auxiliary drums having outer surfaces in contact with each other.

2. The drum as recited in claim 1, comprising a rotary plate mounted under said drum.

3. The drum as recited in claim 2, comprising a plurality of rollers for supporting said rotary plate.

4. The drum as recited in claim 1, comprising a gear plate mounted over said drum.

* * * * *